US007568566B2

(12) United States Patent
D'Ambrosio

(10) Patent No.: US 7,568,566 B2
(45) Date of Patent: Aug. 4, 2009

(54) MAGNETIC CLOSURE SYSTEM

(76) Inventor: Carlo D'Ambrosio, 8552 des Rapides, LaSalle, Quebec (CA) H8P 2W3

( * ) Notice: Subject to any disclaimer, the term of this patent is extended or adjusted under 35 U.S.C. 154(b) by 103 days.

(21) Appl. No.: 11/562,809

(22) Filed: Nov. 22, 2006

(65) Prior Publication Data

US 2008/0116697 A1 May 22, 2008

(51) Int. Cl.
*A45C 13/10* (2006.01)

(52) U.S. Cl. ..... 190/119; 335/278; 335/285; 335/302; 335/303; 206/320; 206/818; 206/315.3; 292/251.5

(58) Field of Classification Search ..... 335/278, 335/285, 302–303; 190/119; 206/320, 818, 206/315.3; 292/251.5
See application file for complete search history.

(56) References Cited

U.S. PATENT DOCUMENTS 2,627,097 A * 2/1953 Ellis ..... 24/303
3,102,314 A * 9/1963 Alderfer ..... 24/303
3,111,735 A * 11/1963 Ellis ..... 24/400
3,629,905 A * 12/1971 Cote ..... 24/30.5 R
3,897,288 A * 7/1975 Fayling ..... 156/289
4,249,267 A * 2/1981 Voss ..... 2/69
4,451,321 A * 5/1984 McKelvey ..... 156/382
4,484,682 A * 11/1984 Crow ..... 206/545
4,825,526 A * 5/1989 Shenier et al. ..... 24/303
5,704,480 A * 1/1998 Scholz et al. ..... 206/438
6,301,754 B1 * 10/2001 Grunberger et al. ..... 24/303
6,412,116 B1 * 7/2002 Clark ..... 2/129
2007/0193902 A1 * 8/2007 Myers et al. ..... 206/320

* cited by examiner

*Primary Examiner*—Elvin G Enad
*Assistant Examiner*—Mohamad A Musleh
(74) *Attorney, Agent, or Firm*—Notaro Michalos P.C.

(57) ABSTRACT

A magnetic fastening system for connecting a first member against a second member. The system includes a first flexible magnet longitudinally associated with at least a portion of an edge of the first member and a second flexible magnet longitudinally associated with at least a portion of an edge of the second member. The first and second flexible magnets are aligned to attract one another as the first and second members are moved into their connected position to then pull the first and second members into connecting contact.

8 Claims, 5 Drawing Sheets

MAGNETIC CLOSURE SYSTEM

FIELD OF THE INVENTION

The present invention relates to closure mechanisms and more specifically to the use of linear magnets for closing and sealing storage enclosures.

BACKGROUND OF THE INVENTION

There are an almost unlimited number of storage enclosures used in different applications. One of the most common types of enclosure is the pocket or pouch found on everything from garments to backpacks, purses, luggage and golf bags. The closure mechanisms for these pockets and pouches are numerous, the most common including zippers, Velcro™, dome fasteners, buttons, clasps, rivets, buckles and tie downs. All of these are useful but all suffer from disadvantages.

Zippers for example can bind or break and can pinch the surrounding fabric to become stuck. Velcro can clog and it is not uncommon for the Velcro to separate from the underlying substrate. Buttons, clasps, dome fasteners and the like must be fastened one at a time, they do not seal against dirt, wind, moisture and weather and they can break off. Moreover, none of the prior art fasteners is self closing. Even Velcro requires the application of a compressive force to make a seal and the force must be applied along the complete length of the Velcro to ensure all parts of the closure are equally secured.

What is required therefore is a closure mechanism that can be simply and inexpensively applied to numerous types of storage enclosures and which is substantially self closing along its entire length, reliable and easy to use and sufficiently flexible that it can be used over a wide variety of different products and applications.

SUMMARY OF THE INVENTION

The present invention provides a magnetic closure system for pouches, pockets and bags and which is also useful for more rigid enclosures.

According to the present invention then, there is provided a magnetic fastening system for connecting a first member to a second member, comprising a first flexible magnet longitudinally associated with at least a portion of an edge of said first member; a second flexible magnet longitudinally associated with at least a portion of an edge of said second member; said first and second flexible magnets being aligned to attract one another as said first and second members are moved into a connected position and to then pull said first and second members into compressive contact.

According to a further aspect of the present invention, there is also provided a magnetic closure system for a storage device having a storage space, an aperture for providing access to and from said storage space and a closure member for opening and closing said aperture; said aperture having a first peripheral edge; said closure member having a second peripheral edge; a first flexible magnet linearly disposed along at least a portion of said first peripheral edge; a second flexible magnet linearly disposed along at least a portion of said second peripheral edge; wherein said first and second magnets are arranged to magnetically attract one another and then magnetically contact one another as said closure member is moved from an open position thereof to a closed position in which said aperture is closed.

According to yet another aspect of the present invention, there is also provided a method of providing closure between a receptacle having an opening therein for access to and from the receptacle's interior space and a closure member for opening and closing said receptacle's opening, comprising the steps of securing a first flexible magnet at least partially around the opening into said receptacle; securing a second flexible magnet on said closure member in opposing relationship to said first flexible magnet, wherein said first and second magnets attract one another and then magnetically contact one another to hold said closure member in compressive contact with said opening.

BRIEF DESCRIPTION OF THE DRAWINGS

Preferred embodiments of the present invention will now be described in greater detail and will be better understood when read in conjunction with the following drawings in which.

DETAILED DESCRIPTION

The following description of the applicant's magnetic closure system is made with reference to pockets on a golf bag. It will be appreciated that this is but a single example of the almost unlimited number of applications for the present system not only for pockets and pouches, but for rigid or semi-rigid containers, as well as for closures for garments and even as a substitute for Velcro enclosures used on footwear and the like. Almost anything that requires a closure mechanism can make use of the magnetic closure system described below.

Figure 1:
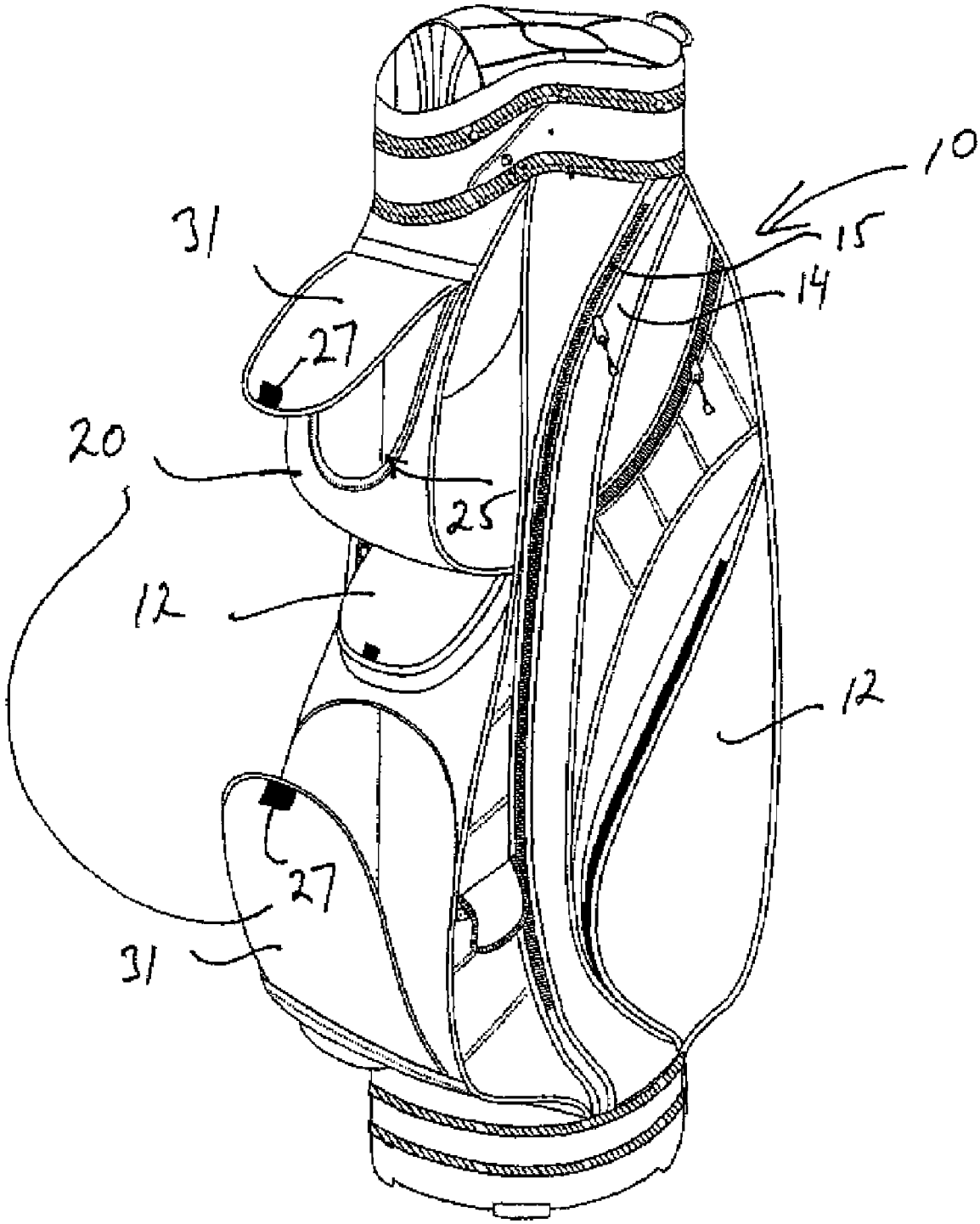
FIG. 1 is a perspective view of a golf bag having numerous pockets including pockets incorporating the magnetic closure system of the present invention.

With reference to FIG. 1, golf bag 10 includes numerous pockets 12 on its front and side surfaces, some of which 14 are conventionally closed by zippers 15, and others 20 of which use the present magnetic closure system 25.

Figure 2:
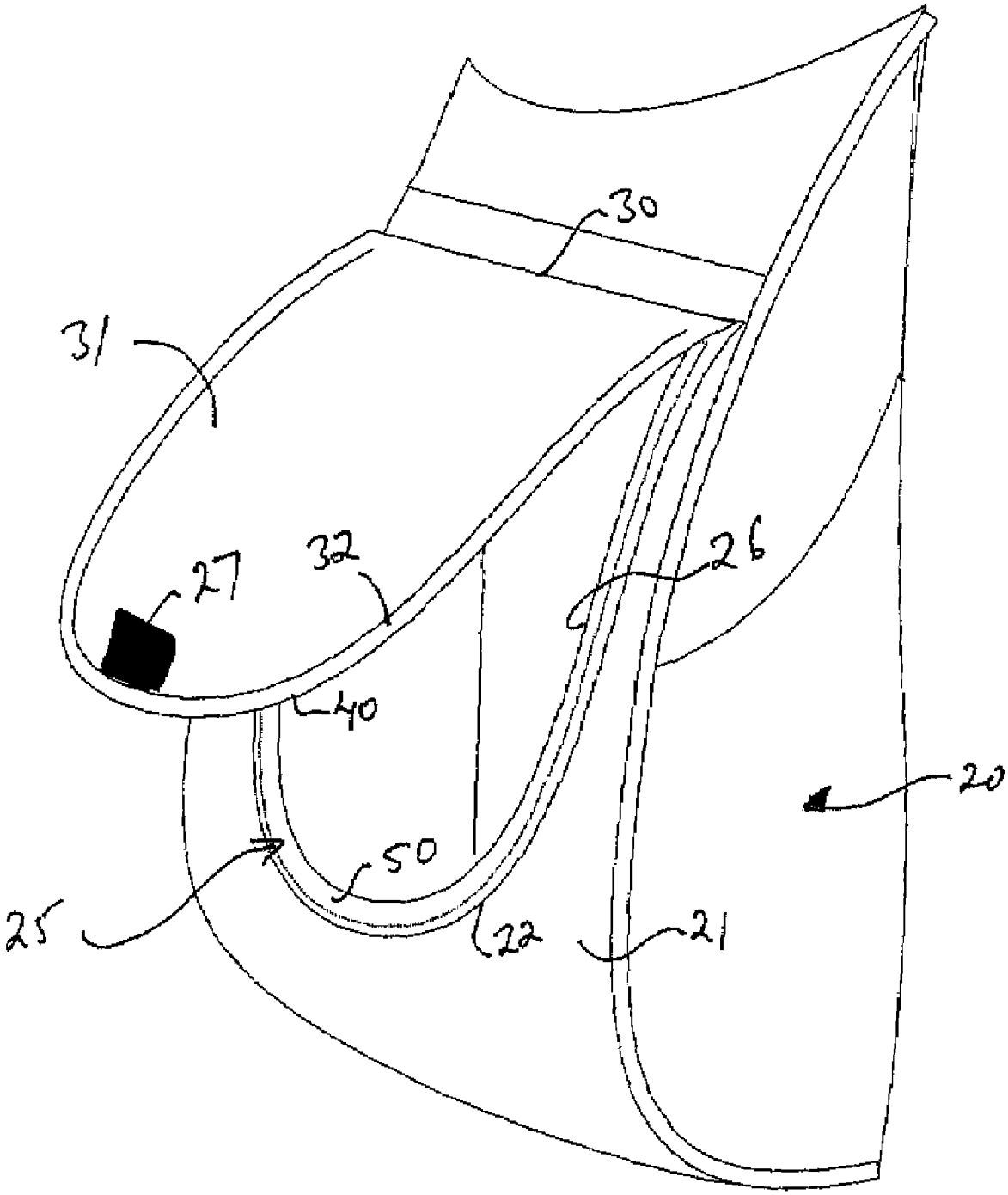
FIG. 2 is a perspective view of one of the pockets for the golf bag of FIG. 1.

With reference to FIG. 2, pocket 20 includes a pouch 21 and a closure flap 31 that closes an opening 26 providing ingress and egress for the pouch. Flap 31 conforms in shape and size to the shape and size of opening 26 to completely seal pouch 21 when the flap is in its closed position. Flap 31 is flexibly and/or hingedly connected to golf bag 10 such as by means of a stitched seam 30. It will be appreciated in this regard that apart from the magnetic closure system itself, the construction of the golf bag itself, the pockets, pouches, closure flaps and other components of the bag are conventional and are manufactured in accordance with methods and technologies and using materials well known in the art. Accordingly, a detailed description of those aspects of the bag that will be well known to persons skilled in the art is being omitted.

Figure 3:
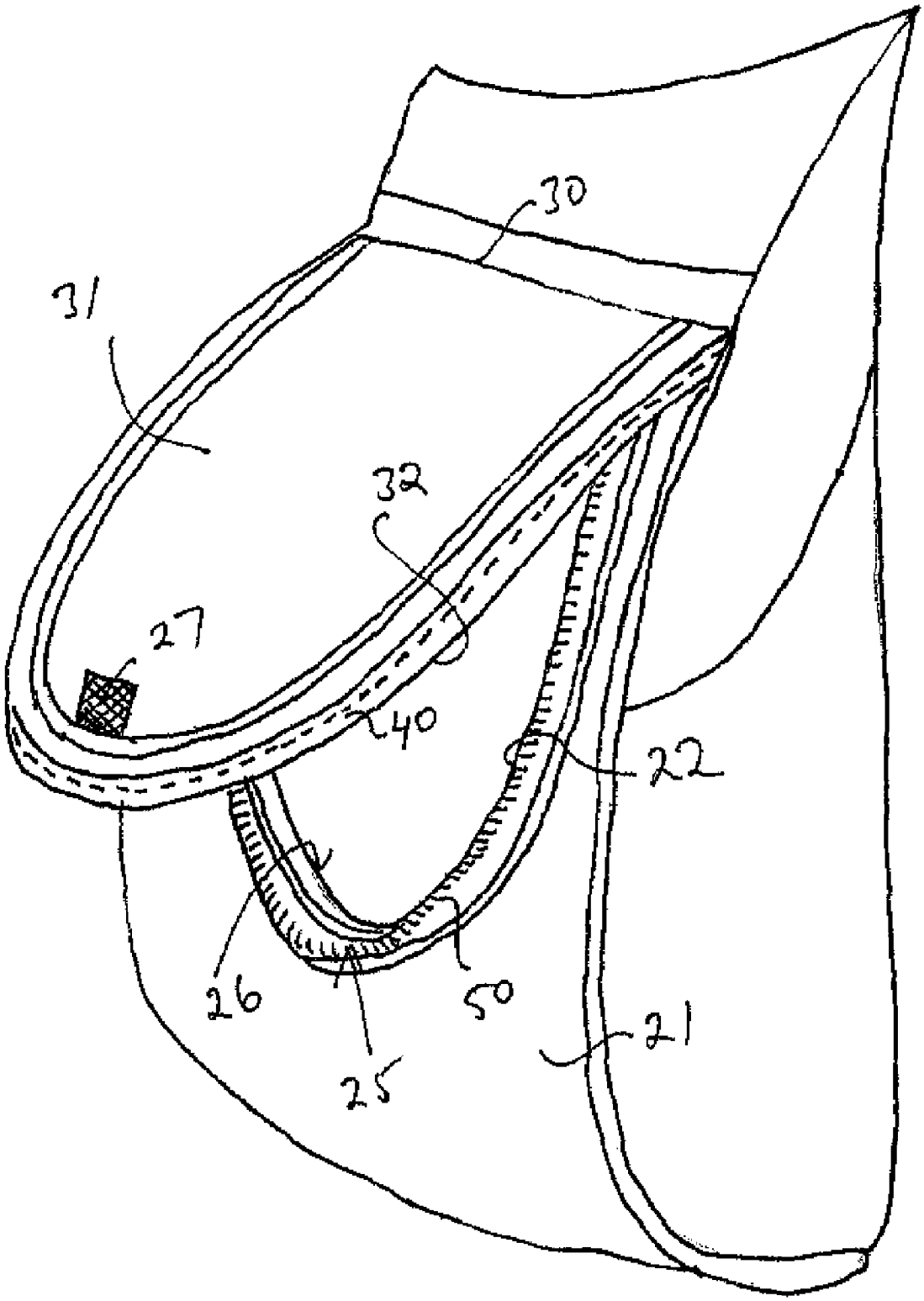
FIG. 3 is a more detailed view of the pocket of FIG. 2.
Figure 4:
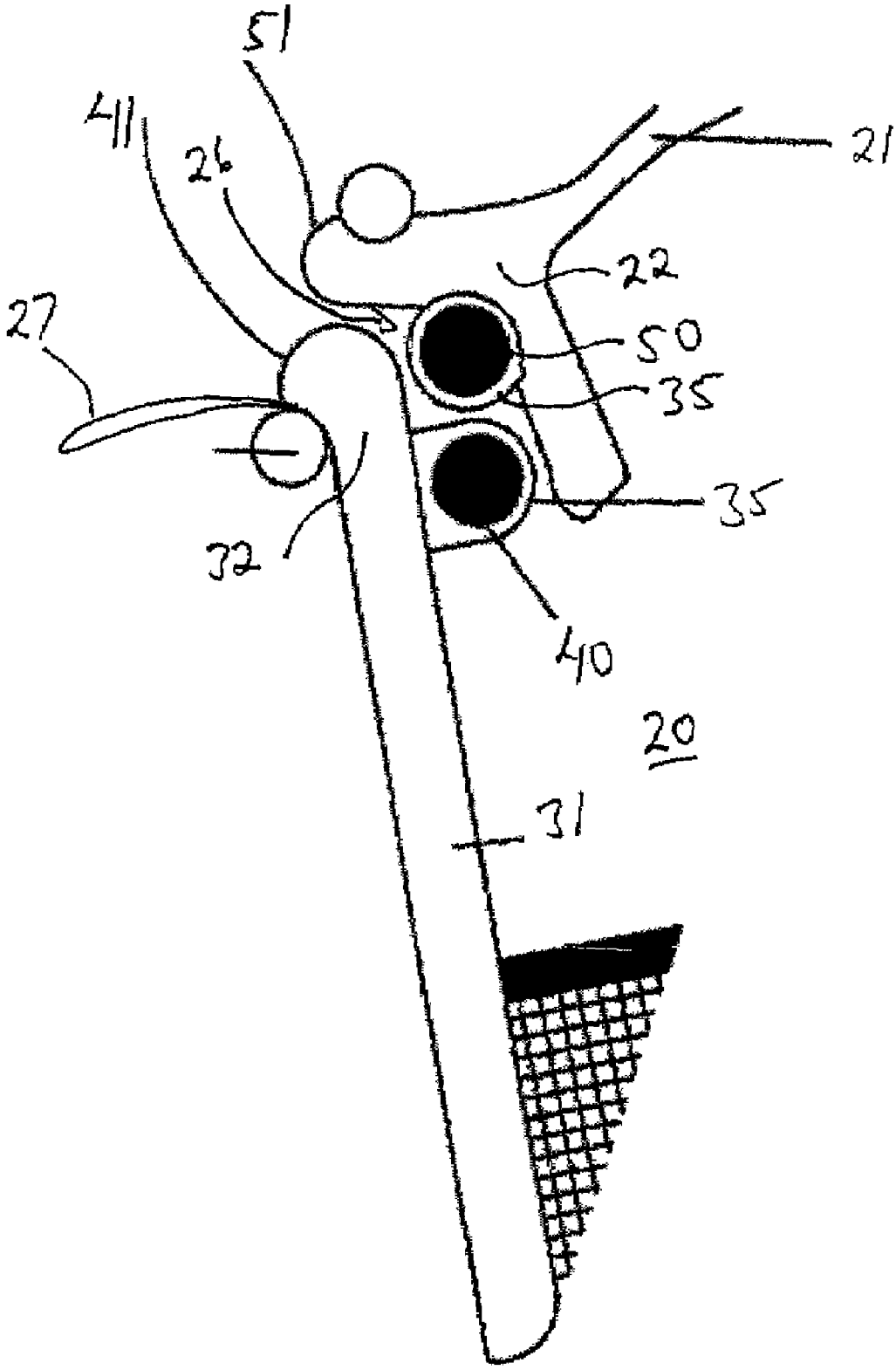
FIG. 4 is a cross sectional view of the magnetic closure system taken along the line 5-5 in FIG. 5.
Figure 5:
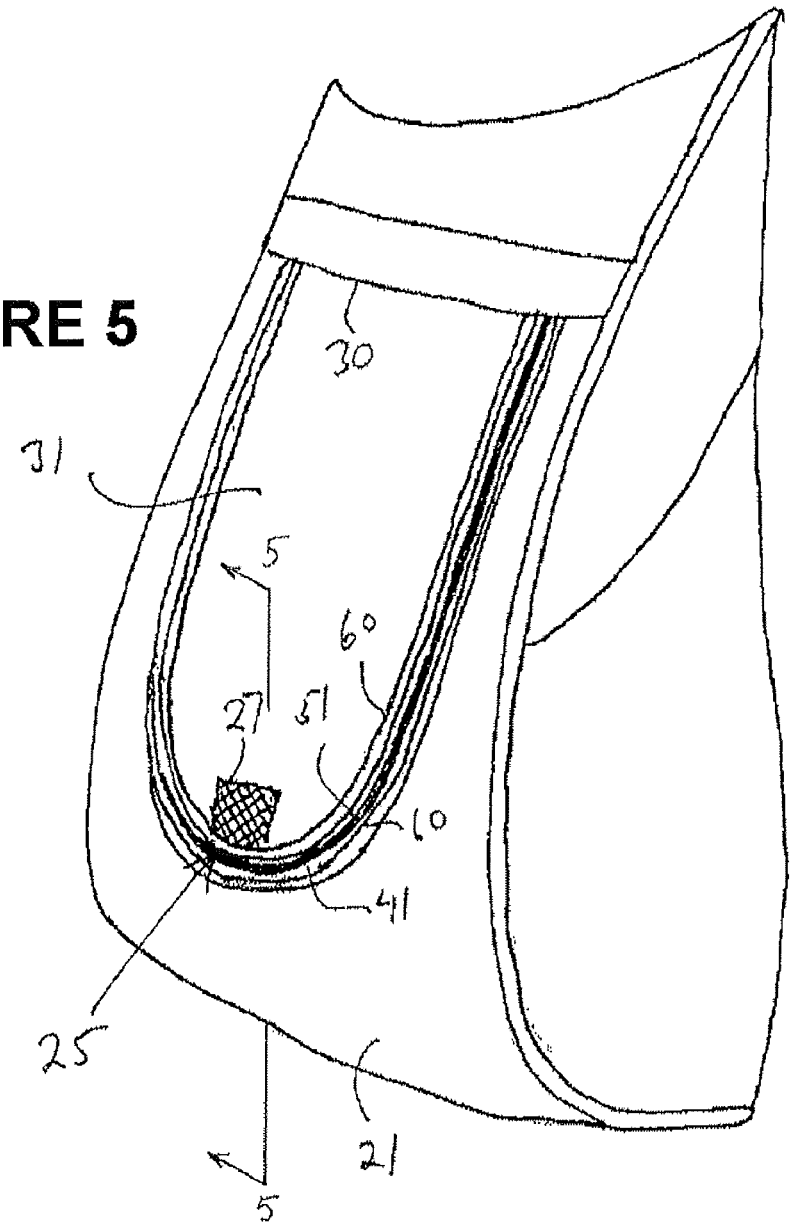
FIG. 5 is another view of the pocket of FIG. 2 when closed by the magnetic closure system.

With reference to FIGS. 2, 3 and 4, the magnetic closure system itself consists of at least first and second magnets such as linear magnetic strips 40 and 50. The strips are preferably flexible and are sewn into the respective peripheral edges 22 and 32 of opening 26 and flap 31. Strips 40 and 50 are commercially available in different sizes and cross sectional shapes. The ones used by the applicant are either round or rectangular in cross sectional shape and are approximately ⅛ inch in diameter/width. The shape and diameter of the strips is not critical but complementing shapes are preferred for an even and uniform seal between them. For heavier duty applications, larger and more powerful strips may be preferred. Strips 40 and 50 are preferably continuous, but they can also consist of discrete segments or even "buttons" spaced closely enough that the segments/buttons behave like a continuous, linear strip.

Magnetic strips 40 and 50 are connected to peripheral edges 22 and 32 by any suitable means. In one embodiment constructed by the applicant, the strips are enclosed within flexible sleeves such as fabric sleeves 35 that cover the strips along their length and that are themselves connected to the peripheral edges such as by means of stitching, glue or ultrasonic welds.

Strips 40 and 50 are arranged to be in magnetic contact with one another when the flap is closed along their entire length around the peripheral edges of the flap and pouch, or at least around as much of the peripheral edges that is to be sealed together. The attraction between the strips holds the flap firmly and conformably in its closed position to completely (or partially, if preferred) close the pocket. In this regard, "magnetic contact" means that strips 40 and 50 will normally abut one another through their respective sleeves 35, but includes being close enough to each other that the magnetic force between them is sufficiently strong to hold the flap firmly closed.

In a preferred embodiment, outwardly adjacent magnetic strips 40 and 50 are opposed, flexible longitudinally extending seals 41 and 51 respectively. These seals can be in the nature of nylon, silicone, rubber, felt, plastic, vinyl, fabric or any other suitable piping and they are connected to peripheral edges 22 and 32 such as by means of stitching, adhesive or any other suitable means. Or, as shown in FIG. 4, the seals can be integral to flap 31 and the peripheral edge 22 of opening 26. In this regard, the seals can be extensions of the flap and the pocket wall that extend outwardly relative to magnetic strips 40 and 50. These seals are positioned so that they lie closely adjacent or preferably actually abut one another when flap 31 is closed to aesthetically cover magnetic strips 40 and 50 and to provide some additional closure or sealing against moisture, dirt, weather and the like. In FIG. 4, magnetic strips 40 and 50 and seals 41 and 51 are shown slightly separated for illustration purposes, but in actual use, the magnets and seals will more ideally compressively abut one another for an effective closure of pocket 20.

Flap 31 is provided with means to open it such as a single sewn on tab 27 that the user can grasp to pull the flap open. Pulling on the tab peels the two magnetic strips apart starting from the tab and moving away from it on opposite sides towards seam 30. The flap can be opened as little or as much as required for access to pouch 21.

If the flap is a floppy piece of fabric without any tendency to naturally return to its closed position, it may be necessary to move the flap in the direction of opening 26 until the magnets engage each other to pull the flap closed from there. Most flaps however especially on golf bags and the like, have at least some rigidity and a tendency to move towards their closed position. This tendency can be increased somewhat if seam 30 is curved which, when combined with the flap's natural rigidity, tends to actually bias the flap towards its closed position. If the flap is of this nature, closure is effected simply by releasing tab 27. The flap will almost "jump" into its fully closed and sealed position due to the attraction between magnetic strips 40 and 50. The closure is instantaneous and precisely aligned without the need to manipulate zippers, buttons or the like or to apply sealing pressure such as would be needed to effectively close Velcro along the entire length of the closure.

Decorative piping 60 can be added adjacent seals 41 and 51 for a more finished look.

As will be appreciated, the same closure mechanism described above with respect to a pocket on a golf bag can be used, for example, to seal lunch bags, totes, backpacks, coolers and virtually any other kind of storage enclosure that can be made more useful or convenient by making it easier to open and close. It will be further appreciated that the closure mechanism can be used on containers or in other applications where the lid or closure member is completely separable from the enclosing compartment. An example would be a storage box having a removable lid. The lid and the enclosing compartment would be provided with magnetic strips along their mating edges for closure purposes.

The above described embodiments of the present invention are meant to be illustrative of preferred embodiments and are not intended to limit the scope of the present invention. Various modifications, which would be readily apparent to one skilled in the art, are intended to be within the scope of the present invention. The only limitations to the scope of the present invention are set forth in the following claims appended hereto.

The embodiments of the invention in which an exclusive property or privilage is claimed are defined as follows:

1. A storage bag system with a magnetic fastening, the system comprising: a bag body; a plurality of pockets spaced on the bag body, each pocket having a pouch and a flap with respective peripheral edges along the pouch and the flap for defining an opening into the pocket when the peripheral edges are spaced from each other in an open position, and for closing the opening when the peripheral edges are adjacent each other in a connected position, the peripheral edges have a selected shape; a first flexible continuous magnetic strip conforming to the selected shape and extending along the peripheral edge of each pouch; a second flexible continuous magnetic strip conforming to the selected shape and extending along the peripheral edge of each flap; said first and second flexible continuous magnetic strips being aligned to attract one another as said pouch and flap are moved into said connected position and to then pull said peripheral edges of said pouch and flap into compressive contact; and pull means connected to each flap for being grasped to pull the flap and its peripheral edge to the open position; a first flexible sealing member disposed to be longitudinally coextensive with said first flexible magnetic strip, and a second flexible sealing member disposed to be longitudinally coextensive with said second flexible magnetic strip.

2. The system of claim 1 wherein said first and second sealing members are aligned closely adjacent one another when said peripheral edges of said pouch and flap are in their connected position.

3. The system of claim 2 wherein said first and second sealing members compressively abut one another when said peripheral edges of said pouch and flap are in their connected position.

4. The system of claim 1 wherein said first and second flexible magnetic strips are each respectively connected to said peripheral edges of said pouch and flap by means of a sheath of flexible material that encloses each of said magnetic strips between said sheath and respective ones of said peripheral edges.

5. The system of claim 1 wherein said first and second flexible sealing members are made of a flexible material selected from the group consisting of fabric, felt, rubber, silicone, plastic and vinyl.

6. The system of claim 1 wherein upon release of said pull means, said first and second flexible magnetic strips automatically re-engage to sealingly close said opening.

7. The system of claim 1 wherein said first and second flexible magnetic strips each comprise a plurality closely spaced segments that behave like a continuous magnet along each respective peripheral edge.

8. The system of claim 1 wherein said first and second flexible magnetic strips are each one-piece continuous magnets.

* * * * *